US009927163B2

(12) United States Patent
Licht et al.

(10) Patent No.: US 9,927,163 B2
(45) Date of Patent: Mar. 27, 2018

(54) DOMESTIC REFRIGERATOR INCLUDING AN ICE DISPENSER

(71) Applicant: WHIRLPOOL CORPORATION, Benton Harbor, MI (US)

(72) Inventors: Kevin E. Licht, Evansville, IN (US); Garett L. Strandemo, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/349,652

(22) Filed: Nov. 11, 2016

(65) Prior Publication Data

US 2017/0059221 A1 Mar. 2, 2017

Related U.S. Application Data

(63) Continuation of application No. 14/665,105, filed on Mar. 23, 2015, now Pat. No. 9,518,772, which is a continuation of application No. 13/669,513, filed on Nov. 6, 2012, now Pat. No. 9,004,325.

(51) Int. Cl.

| | |
|---|---|
| ***F25C 5/00*** | (2006.01) |
| ***B67D 1/08*** | (2006.01) |
| ***F25C 1/04*** | (2018.01) |

(52) U.S. Cl.

CPC ..... *F25C 5/005* (2013.01); *B67D 1/0857* (2013.01); *F25C 1/04* (2013.01)

(58) Field of Classification Search

CPC ..... F25C 5/005; F25C 1/04; B67D 1/0857

USPC ..... 222/477; 62/344

See application file for complete search history.

(56) References Cited

U.S. PATENT DOCUMENTS

| | | | | |
|---|---|---|---|---|
| 942,334 | A | 12/1909 | Meissner | |
| 4,069,545 | A | 1/1978 | Holet et al. | |
| 4,089,436 | A | 5/1978 | Marks | |
| 4,090,641 | A | 5/1978 | Lindenschmidt | |
| 4,102,660 | A * | 7/1978 | Beckett | F25C 5/005 221/311 |
| 4,462,437 | A * | 7/1984 | Prada | E05F 3/04 141/360 |
| 5,473,911 | A | 12/1995 | Unger | |
| 5,526,854 | A | 6/1996 | Unger | |
| 6,135,173 | A | 10/2000 | Lee et al. | |
| 6,533,003 | B1 | 3/2003 | Jacobus et al. | |
| 7,445,137 | B2 | 11/2008 | Noh et al. | |
| 7,571,619 | B2 | 8/2009 | Park et al. | |
| 7,673,469 | B2 | 3/2010 | Park et al. | |

(Continued)

FOREIGN PATENT DOCUMENTS

| | | |
|---|---|---|
| EP | 0940642 A2 | 9/1999 |
| KR | 19990060081 A | 7/1999 |

(Continued)

*Primary Examiner* — Donnell Long

(74) *Attorney, Agent, or Firm* — Price Heneveld LLP

(57) ABSTRACT

An ice dispenser for a domestic refrigerator includes a lever having a housing with a passageway defined therein and a flapper door configured to pivot between a closed position in which ice is prevented from advancing into the passageway and an open position in which ice is permitted to advance into the passageway. A linkage is coupled to the lever and the flapper door such that movement of the lever causes the flapper door to move from the closed position to the open position.

20 Claims, 5 Drawing Sheets

(56) References Cited

U.S. PATENT DOCUMENTS

| | | | | |
|---|---|---|---|---|
| 7,757,512 | B2 | 7/2010 | Park et al. | |
| 7,823,755 | B2 | 11/2010 | Park et al. | |
| 7,841,493 | B2 | 11/2010 | Park et al. | |
| 7,900,469 | B2 | 3/2011 | Gildersleeve | |
| 7,946,125 | B2 | 5/2011 | Visin et al. | |
| 9,004,325 | B2 | 4/2015 | Licht et al. | |
| 2006/0090496 | A1 | 5/2006 | Adamski et al. | |
| 2008/0053133 | A1 | 3/2008 | Park et al. | |
| 2008/0061088 | A1* | 3/2008 | Park | F25C 5/005 222/477 |
| 2009/0013708 | A1 | 1/2009 | Truitt | |
| 2011/0011116 | A1 | 1/2011 | Kim et al. | |

FOREIGN PATENT DOCUMENTS

| | | | |
|---|---|---|---|
| WO | 2007054166 | A1 | 5/2007 |
| WO | 2010099041 | A2 | 9/2010 |
| WO | 2010099454 | A2 | 9/2010 |

* cited by examiner

DOMESTIC REFRIGERATOR INCLUDING AN ICE DISPENSER

CROSS-REFERENCE TO RELATED APPLICATIONS

This application is a continuation of U.S. patent application Ser. No. 14/665,105, filed on Mar. 23, 2015, entitled "DOMESTIC REFRIGERATOR INCLUDING AN ICE DISPENSER," now U.S. Pat. No. 9,518,772, which is a continuation of U.S. patent application Ser. No. 13/669,513, filed on Nov. 6, 2012, entitled "DOMESTIC REFRIGERATOR INCLUDING AN ICE DISPENSER," now issued as U.S. Pat. No. 9,004,325, the entire disclosures of which are hereby incorporated herein by reference.

TECHNICAL FIELD

The present disclosure relates generally to a domestic refrigerator and more particularly to an ice dispenser for a domestic refrigerator.

BACKGROUND OF THE INVENTION

A domestic refrigerator is a device used to store food items in a home at preset temperatures. A domestic refrigerator typically includes one or more temperature-controlled compartments into which food items may be placed to preserve the food items for later consumption. A domestic refrigerator also typically includes a door that permits user access to the temperature-controlled compartment, and many domestic refrigerators also include a dispenser in the door that is operable to dispense water and/or ice.

BRIEF SUMMARY OF THE INVENTION

According to one aspect of the disclosure, a domestic refrigerator is disclosed. The domestic refrigerator includes an ice dispenser positioned in a door of the refrigerator. The ice dispenser includes a mounting bracket, a lever pivotally coupled to the mounting bracket that includes a housing having a passageway defined therein, and a flapper door pivotally coupled to the mounting bracket. The flapper door is configured to pivot between a closed position in which ice is prevented from advancing into the passageway and an open position in which ice is permitted to advance into the passageway. The ice dispenser also includes a rotary damper coupled to the flapper door, and a linkage coupled to the lever and the flapper door such that movement of the lever from a first lever position to a second lever position advances the flapper door from the closed position to the open position. The linkage is configured to permit the lever to move from the second lever position to the first lever position independently of the flapper door, and the rotary damper is configured to resist the movement of the flapper door from the open position to the closed position.

In some embodiments, the flapper door may include a plate positioned at an upper end of the passageway of the housing and a bracket secured to the plate. The bracket may include a lower end moveably coupled to the rotary damper. In some embodiments, the lower end of the bracket of the flapper door may have a first plurality of teeth formed thereon, and the rotary damper may include a shaft having a second plurality of teeth formed thereon. The second plurality of teeth may be meshed with the first plurality of teeth.

Additionally, in some embodiments, the bracket may include a sidewall having a slot defined therein, and the linkage may include a roller positioned in the slot that is configured to move along the slot and a link arm having a first end pivotally coupled to the lever and a second end pivotally coupled to the roller.

In some embodiments, the roller may be positioned at an upper end of the slot of the bracket as the lever is moved from the first lever position to the second lever position, and the roller may be moved away from the upper end of the slot as the lever is moved from the second lever position to the first lever position.

In some embodiments, the ice dispenser may further include a first torsional spring configured to bias the lever in the first lever position. Additionally, in some embodiments, the ice dispenser may also include a second torsional spring configured to bias the flapper door in the closed position. In some embodiments, the first torsional spring may be configured to urge the lever to move from the second lever position to the first lever position at a first rotational speed, and the rotary damper may be configured to permit the flapper door to move from the open position to the closed position at a second rotational speed that is less than the first rotational speed.

In some embodiments, the lever may further include a paddle extending downwardly from the housing, and the paddle may have a curved surface configured to receive a container for ice.

Additionally, in some embodiments, the refrigerator may include a cabinet having a temperature-controlled compartment defined therein and the door pivotally coupled to the cabinet. The door may include a door panel that defines a front surface of the door and has an opening defined therein. The door may also include a housing positioned in the opening of the door panel. The housing may have the mounting bracket secured thereto.

In some embodiments, the ice dispenser may include an ice bin sized to contain ice, a motor operable to advance ice from the ice bin, and a switch operable to control the motor, and the lever may include a control arm configured to operate the switch to energize the motor. The control arm may operate the switch when the lever is in the second lever position.

In some embodiments, the refrigerator may include a chute configured to guide ice to the passageway of the housing. The chute may have a mouth positioned adjacent to an upper end of the passageway. When the flapper door is in the closed position, the flapper door may be positioned over the mouth of the chute, and when the flapper door is in the open position, the flapper door may be spaced apart from the mouth of the chute.

According to another aspect, a domestic refrigerator includes an ice dispenser that is positioned in a door. The ice maker includes a lever configured to pivot about an axis. The lever includes a housing having a passageway defined therein that is sized to receive ice. The ice dispenser also includes a flapper door configured to pivot between a closed position in which ice is prevented from advancing into the passageway and an open position in which ice is permitted to advance into the passageway. The flapper door includes a bracket having a curved slot defined therein. The ice dispenser includes a rotary damper that is engaged with the bracket of the flapper door and is configured to resist movement of the flapper door. The ice dispenser also has a roller positioned in the curved slot of the bracket of the flapper door that is configured to move along the curved slot and a link having a first end pivotally coupled to the lever and a second end pivotally coupled to the roller.

When the lever is pivoted about the axis in a first direction, the link is configured to advance the roller and the bracket upward such that the flapper door is moved from the closed position to the open position. When the lever is pivoted about the axis in a second direction opposite the first direction, the roller is moved downward along the curved slot such that the flapper door is permitted to move between the open position and the closed position.

In some embodiments, the bracket of the flapper door may include a convex lower surface. The convex lower surface may have a first plurality of teeth defined thereon, and the rotary damper may include a second plurality of teeth that are meshed with the first plurality of teeth. Additionally, in some embodiments, the lever may be configured to pivot about the axis in the second direction at a first rotational speed, and the rotary damper may be configured to resist movement of the flapper door as the flapper door is moved from the open position to the closed position such that the flapper door is moved at a second rotational speed that is less than the first rotational speed.

In some embodiments, the ice dispenser may include a biasing element configured to bias the flapper door in the closed position. Additionally, in some embodiments, the refrigerator may include a cabinet having a temperature-controlled compartment defined therein, the door pivotally coupled to the cabinet, and a mounting bracket secured to the door. The mounting bracket may have the lever and the flapper door pivotally coupled thereto.

In some embodiments, the refrigerator may further include a chute in the door, the chute having a mouth positioned adjacent to an upper end of the passageway. When the flapper door is in the closed position, the flapper door may be positioned over the mouth of the chute such that ice is prevented from advancing into the upper end of the passageway. When the flapper door is in the open position, the flapper door may be spaced apart from the mouth of the chute such that ice is permitted to advance into the upper end of the passageway.

According to another aspect, an ice dispenser for a domestic refrigerator includes a lever configured to move between a first lever position and a second lever position, and the lever includes a housing having a passageway defined therein. The ice dispenser also includes a first spring to bias the lever in the first lever position, and a flapper door configured to pivot between a closed position in which ice is prevented from advancing into the passageway and an open position in which ice is permitted to advance into the passageway. The flapper door includes a bracket having a slot defined therein. The ice dispenser also includes a second spring to bias the flapper door in the closed position, a roller that is positioned in the slot of the bracket of the flapper door and is configured to move along the slot, and a link having a first end pivotally coupled to the lever and a second end pivotally coupled to the roller. Movement of the lever from the first lever position to the second lever position advances the roller and the bracket about an axis such that the flapper door is moved from the closed position to the open position, and movement of the lever from the second lever position to the first lever position causes the roller to move along the slot such that the flapper door is permitted to move from the open position to the closed position.

In some embodiments, the ice dispenser may include a rotary damper coupled to the flapper door. The rotary damper may be configured to resist movement of the flapper door from the open position to the closed position. Additionally, in some embodiments, the ice dispenser may include an ice bin sized to contain ice, a motor operable to advance ice from the ice bin, and a switch operable to control the motor. The lever may include a control arm configured to operate the switch to energize the motor, and the control arm may operate the switch when the lever is in the second lever position.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
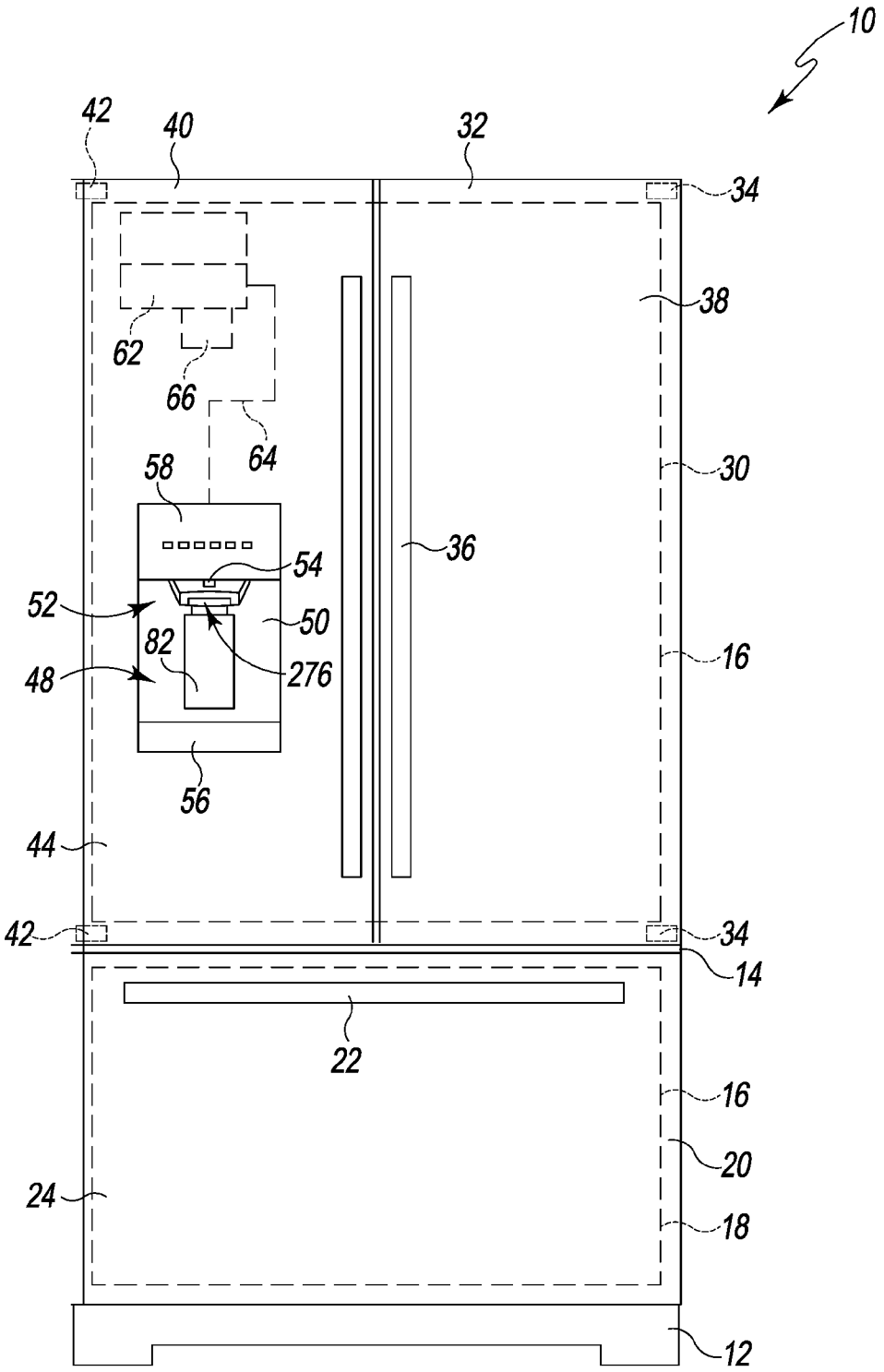
FIG. 1 is a front elevation view of a domestic refrigerator showing an ice dispenser.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a domestic refrigerator appliance 10 (hereinafter refrigerator 10). The refrigerator 10 includes a lower frame 12 and a cabinet 14 extending upwardly from the lower frame 12. The refrigerator cabinet includes a pair of temperature-controlled compartments 16 that are independently operable to maintain food items stored therein at set temperatures.

The lower temperature-controlled compartment 16 is a freezer compartment 18, and the refrigerator 10 includes a drawer 20 that is positioned in the freezer compartment 18. The drawer 20 is moveable relative to the cabinet 14 such that food items may be placed in the drawer 20 for storage in the freezer compartment 18 and retrieved from the drawer 20 when ready for use. A handle 22 is located on a front panel 24 of the drawer 20, and the user may use the handle 22 to pull the drawer 20 open and closed.

The upper temperature-controlled compartment 16 is a refrigerated compartment 30 into which a user may place and store food items such as milk, cheese, produce, etcetera. A door 32 is hinged to the front of the refrigerator cabinet 14 via a pair of hinge assemblies 34. The door 32 permits user access to the refrigerated compartment 30 such that food items may be placed in and retrieved from the compartment 30. A handle 36 is located on a front panel 38 of the door 32, and the user may grasp the handle 36 to pull the door 32 open.

Another door 40 is positioned adjacent to the door 32 and is hinged to the front of the refrigerator cabinet 14 via a pair of hinge assemblies 42. The door 40 also permits user access to the refrigerated compartment 30 such that food items may be placed in and retrieved from the compartment 30. The door 40 includes a front panel 44 having a handle 46 secured thereto, and the user may grasp the handle 46 to pull the door 32 open. As shown in FIG. 1, the front panels 24, 38, 44 of the drawer 20 and doors 32, 40, respectively, define the front of the refrigerator 10.

While in the exemplary embodiment the refrigerator 10 is a "french-door" model with two doors operable to permit access to the refrigerated compartment, it should be appreciated that other configurations are contemplated, such as, for example, having the refrigerated compartment on one side of the cabinet and the freezer compartment on the opposite side of the cabinet. It should also be appreciated that the freezer compartment may be positioned above the refrigerated compartment. Additionally, it should be appreciated that the refrigerator 10 may include more than one refrigerated compartment and/or more than one freezer compartment. It should be further appreciated that in other embodiments one of the temperature-controlled compartments 16 may be omitted.

As shown in FIG. 1, the front panel 44 of the door 40 has an opening 48 defined therein adjacent to the handle 46. The refrigerator 10 includes a dispenser housing 50 that is positioned in the opening 48 and secured to the door 40. The refrigerator 10 also includes an ice dispenser 52 and a fluid dispenser 54 that are secured to the housing 50. The fluid dispenser 54 is operable to dispense cold water or other fluids, and the ice dispenser 52 is operable to dispense crushed ice or ice cubes, as described in greater detail below. The housing 50 includes a platform 56 that is positioned below the dispensers 52, 54, and the platform 56 is sized such that a cup, mug, or other container may be positioned thereon to receive ice or fluid dispensed through the dispensers 52, 54. A user interface 58 is positioned in the panel 44 of the door 40 above the housing 50, and the user interface 58 includes a number of controls 60, such as buttons and switches, that may be used to control the operation of the dispensers 52, 54.

The refrigerator 10 has an ice bin 62 that is sized to contain ice produced by an ice maker (not shown). As shown in FIG. 1, the ice bin 62 is positioned in the refrigerated compartment 30. The ice dispenser 52 of the refrigerator 10 includes a motor 66 and an auger (not shown) that are operable to advance ice from the bin 62 into a chute 64 defined in the door 40. It should be appreciated that in other embodiments the ice bin may be positioned in, for example, the freezer compartment. Additionally, in other embodiments, the ice bin may be secured to the door.

Figure 2:
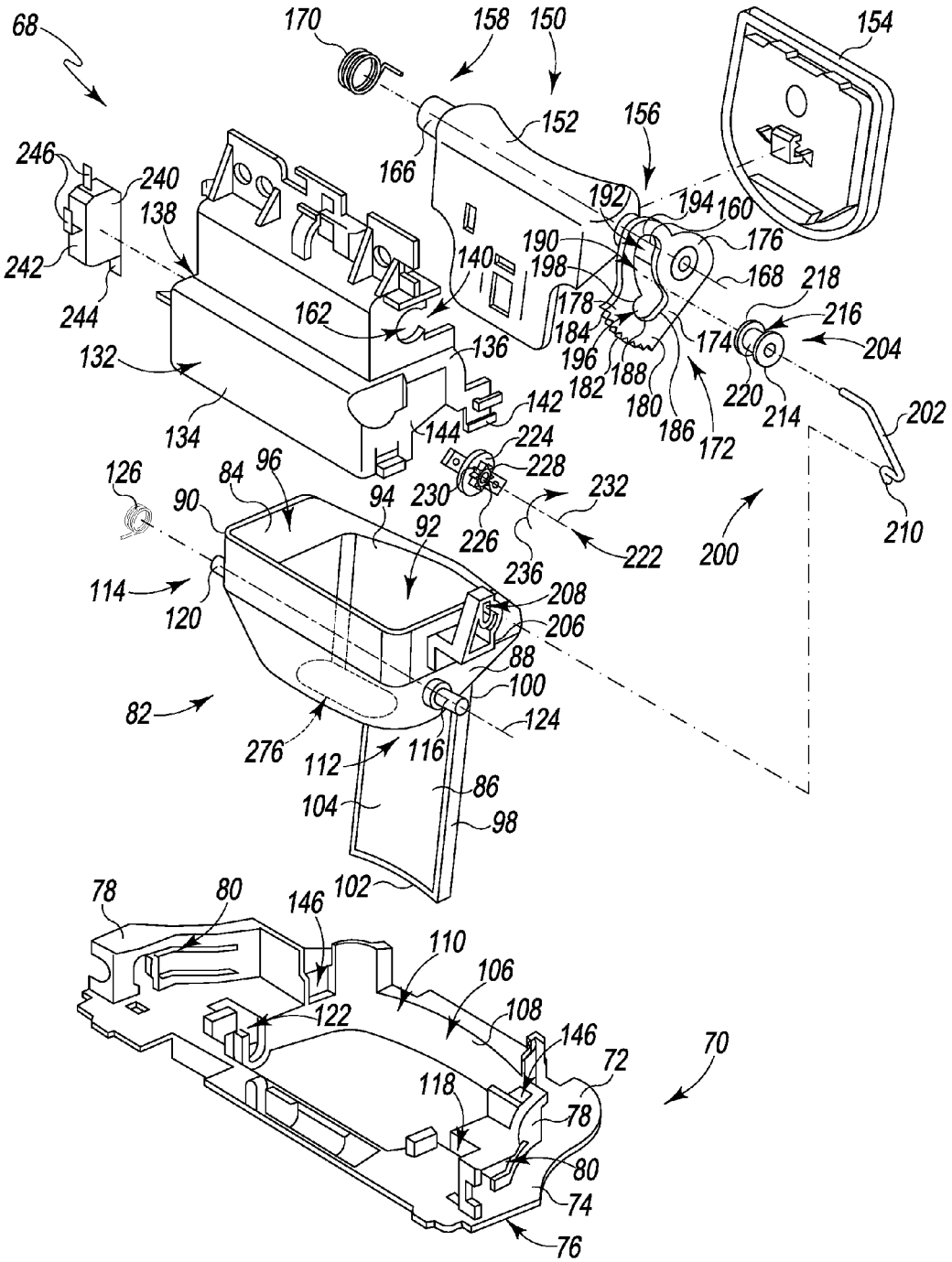
FIG. 2 is an exploded perspective view a separator of the ice dispenser of FIG. 1.

As shown in FIG. 2, the ice dispenser 52 includes a separator assembly 68 that is configured to be positioned in the dispenser housing 50. The separator assembly 68 of the ice dispenser 52 includes a mounting bracket 70 that is secured to the housing 50. The mounting bracket 70 includes a frame 72 having an upper surface 74 and a lower surface 76 positioned opposite the upper surface 74. A pair of side walls 78 extends upwardly from the upper surface 74 of the frame 72. Each side wall 78 has a horizontal slot 80 defined therein that receives a corresponding tab (not shown) of the housing 50. The engagement between the tabs and the slots 80 secures the mounting bracket 70 to the housing 50. It should be appreciated that in other embodiments the mounting bracket 70 may be secured to the housing 50 via fasteners, such as, for example, screws, bolts, adhesives, and so on.

The ice dispenser 52 also includes a lever 82, which is configured to pivot relative to the mounting bracket 70. The lever 82 of the ice dispenser 52 includes a housing 84 and a paddle 86 extending downwardly from a lower end 88 of the housing 84. The housing 84 has an upper end 90 positioned opposite the lower end 88, and an opening 92 is defined in the upper end 90 of the housing 84. As shown in FIG. 2, a sloped inner wall 94 extends downwardly from the opening 92 to define a passageway or guideway 96 through the housing 84. The guideway 96 is sized to receive ice advanced down the chute 64 from the bin 62, as described in greater detail below.

The paddle 86 of the lever 82 has a body 98 that is connected to the housing 84 at an upper end 100. The body 98 extends from the upper end 100 to a lower edge 102. As shown in FIG. 1, the lower edge 102 of the paddle 86 is positioned above the platform 56 of the dispenser housing 50. The body 98 of the paddle 86 has a concave front surface 104 that is sized to be engaged by a cup, glass, or other fluid container, which may be positioned below the lower outlet of the guideway 96 to receive ice dispensed therefrom.

As shown in FIG. 2, the frame 72 of the mounting bracket 70 has an opening 106 defined in the upper surface 74. An inner wall 108 extends downwardly from the opening 106 to define a slot 110 through the frame 72. When the ice dispenser 52 is assembled, the housing 84 of the lever 82 is positioned in the slot 110, with the paddle 86 positioned below the lower surface 76 of the mounting bracket 70.

The lever 82 of the ice dispenser 52 is coupled to the mounting bracket 70 via a pair of pivot joints 112, 114. The pivot joint 112 includes a cylindrical pin 116 extending outwardly from the housing 84 of the lever 82. The pin 116 is received in a groove 118 that is defined in the frame 72 of the mounting bracket 70. The other pivot joint 114 includes a cylindrical pin 120 that extends outwardly from the housing 84 opposite the pin 116. The pin 120, like the pin 116, is received in a groove 122 defined in the frame 72 of the mounting bracket 70. As described in greater detail below, the lever 82 is configured to pivot about an axis 124 defined by the pins 116, 120. As shown in FIG. 2, a biasing element, such as, for example, torsional spring 126 is positioned over the pin 120. The spring 126 is configured to bias the lever 82 an outward position about the axis 124 (see FIG. 4).

The separator assembly 68 of the ice dispenser 52 includes a support base 132 that is secured to the mounting bracket 70. The support base 132 includes a front wall 134 and a pair of side walls 136, 138 that define a chamber 140 in the support base 132. A plurality of flanges 142 extend outwardly from a lower end 144 of the side walls 136, 138 of the base 132. Each flange 142 is received in a corresponding slot 146 defined in the upper surface 74 of the mounting bracket 70, thereby securing the base 132 to the mounting bracket 70. It should be appreciated that in other embodiments the base 132 may secured to the mounting bracket 70 via fasteners, such as, for example, screws, bolts, adhesives, and so on. It should also be appreciated that in other embodiments the base 132 and the mounting bracket 70 may be formed as a single monolithic component.

As shown in FIG. 2, the ice dispenser 52 also includes a flapper door 150, which is configured to pivot relative to the base 132 and the bracket 70. The flapper door 150 includes a support frame 152 that is positioned in the chamber 140 of the base 132 and a cover plate 154 that is secured to the support frame 152. As described in greater detail below in reference to FIG. 4, the cover plate 154 is sized to be positioned over the mouth 262 of the chute 64. The flapper door 150 is secured to the base 132 via a pair of pivot joints 156, 158. The pivot joint 156 includes a cylindrical pin 160 extending outwardly from the support frame 152 of the flapper door 150. The pin 160 is received in a channel 162 defined in the side wall 136 of the base 132.

The other pivot joint 158 includes a cylindrical pin 164 that extends outwardly from the support frame 152 of the flapper door 150 opposite the pin 160. The pin 164 is received in a channel 166 (see FIG. 3) defined in the side wall 138 of the base 132. As described in greater detail below, the flapper door 150 is configured to pivot about an axis 168 defined by the pins 160, 164. As shown in FIG. 2, a biasing element, such as, for example, torsional spring 170 is positioned over the pin 164. The spring 170 is configured to bias the flapper door 150 in a closed position about the axis 168 (see FIG. 4).

The flapper door 150 of the ice dispenser 52 also includes a bracket 172 that is positioned outside of the chamber 140. As shown in FIG. 2, the bracket 172 has a body 174 that is attached at an upper end 176 to the pin 160. The body 174 includes an outer side surface 178 that extends between the upper end 176 and a lower end 180 of the bracket 172. The lower end 180 of the bracket 172 has a bottom surface 182, which has a convex shape. A plurality of teeth 184 are formed on the bottom surface 182 of the bracket 172.

The outer side surface 178 of the bracket 172 has an opening 186 defined therein, and an inner wall 188 extends inwardly from the opening 186 to an opening (not shown) defined in the opposite inner side wall. The inner wall 188 defines a slot 190 that extends through the bracket 172. As shown in FIG. 2, the slot 190 of the bracket 172 has a curved upper track 192 that extends from an upper end 194 and a notch 196 that is defined at the lower end 198 of the slot 190.

The ice dispenser 52 of the refrigerator 10 further includes a linkage 200 that connects the lever 82 with the flapper door 150. The linkage 200 includes a link arm 202 and a roller bushing 204 pivotally coupled the link arm 202. As shown in FIG. 2, the housing 84 of the lever 82 includes a drive arm 206 that extends outwardly therefrom. The drive arm 206 of the housing 84 has an aperture 208 defined therein that receives a lower end 210 of the link arm 202. The link arm 202 of the linkage 200 is configured to pivot relative to the drive arm 206 of the lever 82 as the lever 82 is moved about the axis 124.

The roller bushing 204 of the linkage 200 includes a cylindrical body 214. The cylindrical body 214 has a channel 216 defined therein, which extends inwardly from the outer surface 218 of the body 214. As shown in FIG. 2, the body 214 has an inner rod 220 at the base of the channel 216. The inner rod 220 is sized to be received within the slot 190 defined in the bracket 172 such that the roller bushing 204 may move along the slot 190 between the upper end 194 and the lower end 180. The channel 216 of the bushing 204 is sized such that the body 214 of the roller bushing 204 engages the outer side surface 178 and the inner side surface of the bracket 172 to retain the bushing 204 in the slot 190.

As shown in FIG. 2, the ice dispenser 52 of the refrigerator 10 also includes a rotary damper 222, which is configured to resist the movement of the flapper door 150 about the axis 168. One example of a rotary damper is available from ITW Fastex of Des Plaines, Ill. USA. The rotary damper 222 includes a shell 224 that is secured to the side wall 136 of the support base 132. A shaft 226 extends from the shell 224, and the rotary damper 222 includes a gear 228 that is secured to the shaft 226. The outer surface of the gear 228 has a plurality of teeth 230 formed thereon. The teeth 230 of the rotary damper 222 are configured to be meshed with the teeth 184 formed on the bottom surface 182 of the bracket 172.

The shaft 226 (and hence gear 228) of the damper 222 is configured to rotate about an axis 232. In the illustrative embodiment, greater torque is required to rotate the damper 222 in the direction indicated by arrow 234 than in the direction opposite arrow 234. In that way, the damper 222 is configured to resist movement of the direction indicated by the arrow 234.

Figure 3:
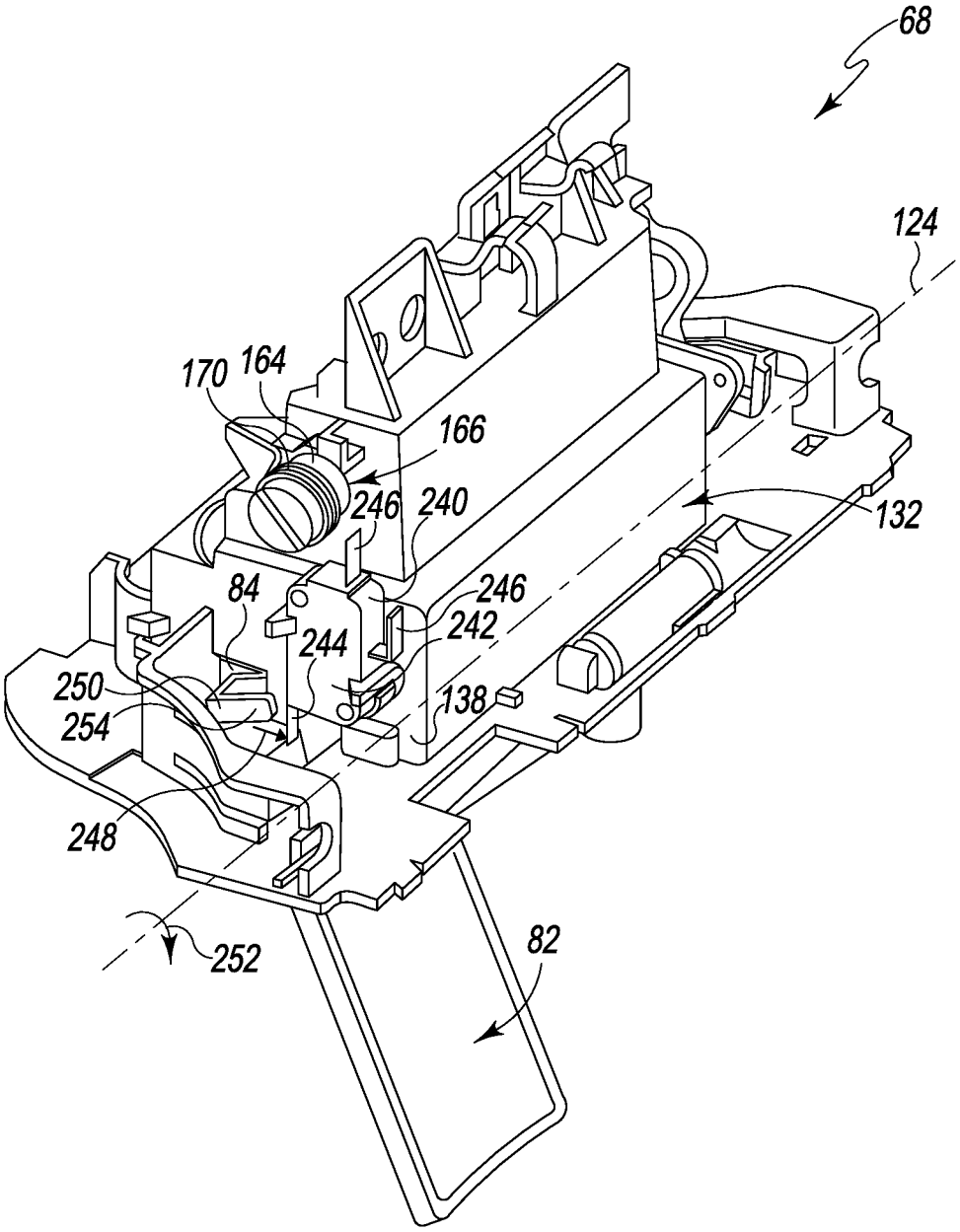
FIG. 3 is a perspective view of the separator of FIG. 2 showing a switch operable to control a motor of the ice dispenser.

As shown in FIGS. 2 and 3, the ice dispenser 52 also includes a mechanical switch 240, which is operable to control the motor 66. The mechanical switch 240 is secured to the side wall 138 of the support base 132 and includes a body 242 having a contact arm 244 pivotally coupled thereto. The switch 240 includes a pair of electrical terminals 246 that extend from the body 242. The terminals 246 are electrically-coupled the motor 66 via a wire harness (not shown). When the contact arm 244 is moved in the direction indicated by arrow 248, the motor 66 is energized such that ice is advanced from the bin 62 and into the chute 64. When the contact arm 244 is positioned as shown in FIG. 3, the motor 66 is de-energized.

The lever 82 of the ice dispenser 52 is operable to control the switch 240. As shown in FIG. 3, the housing 84 of the lever 82 has a control arm 250 extending outwardly therefrom. When the lever 82 is pivoted about the axis 124 in the direction indicated by arrow 252, the tip 254 of the control arm 250 is advanced into contact with the contact arm 244, thereby causing the contact arm 244 to move in the direction indicated by arrow 248 such that the motor 66 energized as described above.

In the illustrative embodiment, the mounting bracket 70 and the support base 132 are formed as single monolithic components from rigid or semi-rigid polymeric materials. It should be appreciated that in other embodiments the mounting bracket 70 and the support base 132 may be formed from die-cast metal or other metallic material. The lever 82, the support frame 152, and cover plate 154 are similarly formed from one or more rigid or semi-rigid polymeric materials.

Figure 5:
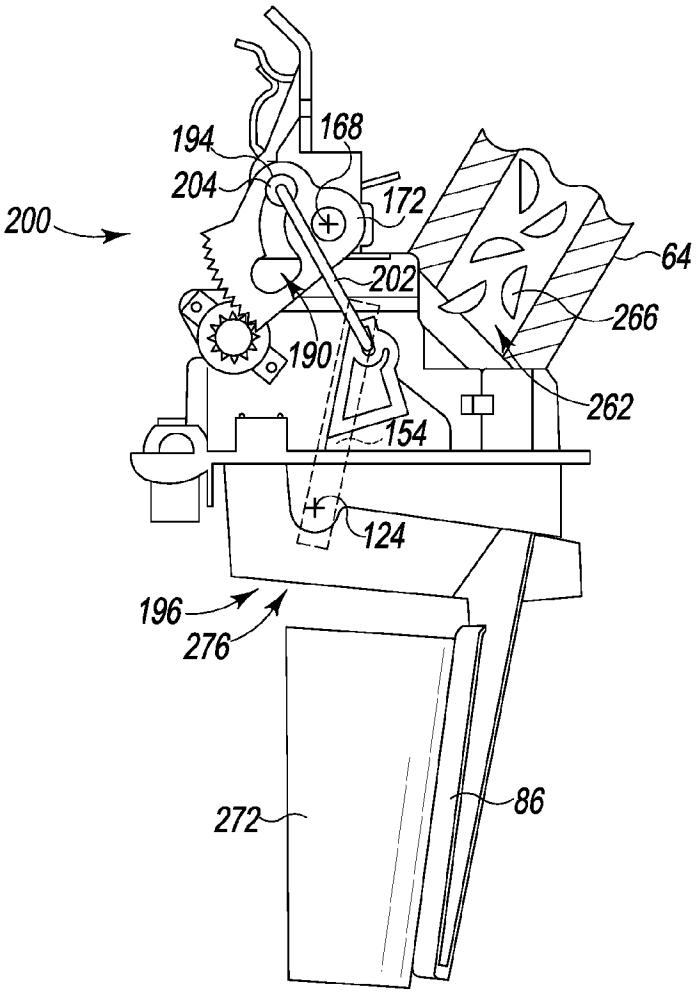
FIG. 5 is a side elevation view similar to FIG. 4 showing the flapper door of the ice dispenser in an open position.
Figure 4:
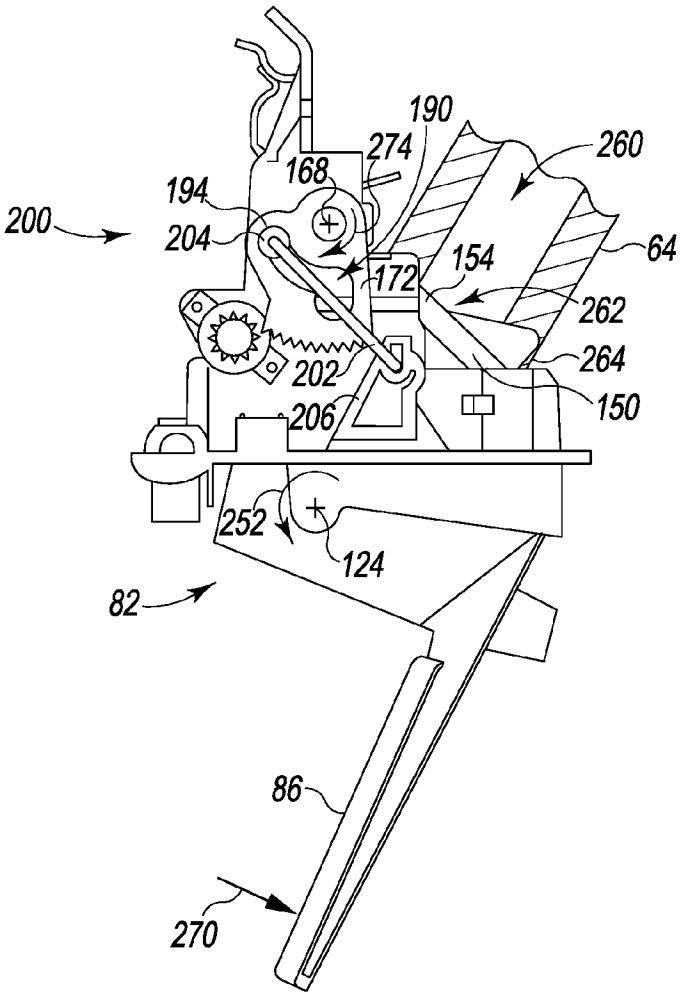
FIG. 4 is a side elevation view showing the flapper door of the ice dispenser of FIG. 1 in a closed position.
Figure 6:
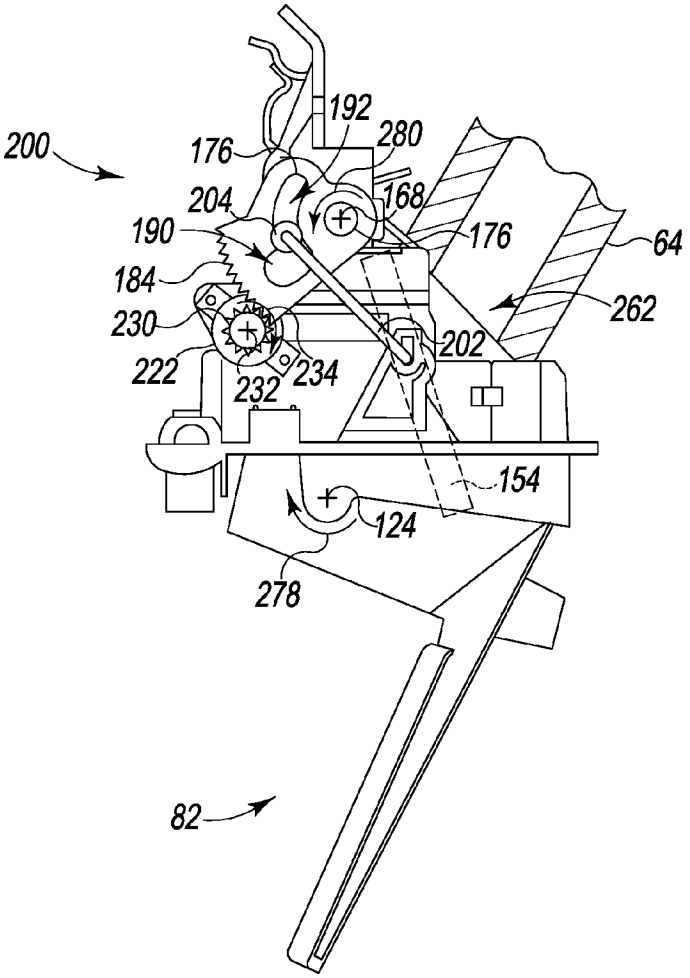
FIG. 6 is a side elevation view similar to FIGS. 4 and 5 showing the flapper door between the closed position of FIG. 4 and the open position of FIG. 5.

Referring now to FIGS. 4-6, various operating positions of the ice dispenser 52 are shown. As shown in FIG. 4, the chute 64 has a passageway 260 defined therein. The upper end (not shown) of the chute 64 is positioned adjacent the ice bin 62 such that ice may be advanced by the motor 66 into the passageway 260. The passageway 260 has a mouth 262 positioned at a lower end 264 of the chute 64 through which ice may exit the chute 64.

As shown in FIG. 4, the flapper door 150 of the separator 68 is in a closed position in which the cover plate 154 is positioned over the mouth 262. In the closed position, ice 266 is prevented from advancing out of the chute 64 into the guideway 96 of the lever 82. To move the flapper door 150 to an open position in which ice is permitted to advance into the guideway 96, force may be applied to the paddle 86 of the lever 82 in the direction indicated by arrow 270, thereby causing the lever 82 to pivot about the axis 124 in the direction indicated by arrow 252. As shown in FIGS. 4 and 5, a cup 272 may be used to apply force to the paddle 86 to move the lever 82 from an outward position (see FIG. 4) to a depressed position (see FIG. 5). In the illustrative embodiment, the paddle 86 is moved approximately 16 to 18 degrees when the lever 82 travels from the outward position to the depressed position.

As the lever 82 is pivoted about the axis 124 from the outward position to the depressed position, the linkage 200 connecting the lever 82 and the flapper door 150 causes the flapper door 150 to pivot about the axis 168 in the direction indicated by arrow 274. To do so, the drive arm 206 of the lever 82 is advanced forward and upward when the lever 82 is pivoted about the axis 124. As described above, the movement of the drive arm 206 causes movement of the link arm 202. Because the roller bushing 204 is positioned at the upper end 194 of the slot 190 of the bracket 172, the movement of the link arm 202 advances the roller bushing 204 upward, thereby causing the bushing 204 and the bracket 172 (and hence the flapper door 150) to pivot about the axis 168 in the direction indicated by arrow 274. As shown in FIG. 5, when the lever 82 is in the depressed position, the flapper door 150 is in an open position in which the cover plate 154 is spaced apart from the mouth 262 of the chute 64. In the illustrative embodiment, the cover plate 154 is rotated approximately 45 degrees as the flapper door 150 pivots from the closed position to the open position.

Additionally, as described above, when the lever 82 is pivoted about the axis 124 in the direction indicated by arrow 252, the tip 254 of the control arm 250 is advanced into contact with the contact arm 244 of the mechanical switch 240, thereby energizing the motor 66 to advance ice 266 from the bin 62 into the chute 64. As shown in FIG. 5, ice 266 moves down the passageway 260 of the chute 64. Because the cover plate 154 of the flapper door 150 is spaced apart from the mouth 262 of the chute 64, ice 266 is permitted to advance from the mouth 262 into the guideway 96 of the lever 82. The ice 266 may then move down the guideway 96 into the cup 272 positioned below the outlet 276 of the guideway 96.

Referring now to FIG. 6, when the cup 272 is removed from the paddle 86, the torsional spring 126 urges the lever 82 to pivot about the axis 124 in the direction indicated in FIG. 6 by arrow 278. As the lever 82 pivots about the axis 124, the tip 254 of the control arm 250 is moved out of contact with the contact arm 244 of the mechanical switch 240, thereby de-energizing the motor 66. The spring 126 causes the lever 82 to move from the depressed position to the outward position at a predetermined rotational speed. In the illustrative embodiment, the predetermined rotational speed is greater than 1.5 rpm.

As the lever 82 pivots about the axis 124 at the predetermined rotational speed, the link arm 202 of the linkage 200 pulls the roller bushing 204 down the curved upper track 192, thereby permitting the lever 82 to move from the depressed position to the outward position independently of the flapper door 150. As the roller bushing 204 moves away from the upper end 176 of the slot 190, the flapper door 150 is permitted to pivot about the axis 168 in the direction indicated by arrow 280 independently of the lever 82. The spring 170 urges the flapper door 150 to pivot about the axis 168 in the direction indicated in FIG. 6 by arrow 280.

The movement of the flapper door 150 about the axis 168 is resisted or damped by the rotary damper 222. As described above, the teeth 184 of the bracket 172 are meshed with the teeth 230 of the damper 222. As the flapper door 150 is pivoted in the direction indicated by arrow 280, the engagement between the teeth 184, 230 causes the gear 228 of rotary damper 222 to rotate about the axis 232 in the direction indicated by arrow 234. As described above, the rotary damper 222 is configured to resist that rotation, and the damper 222 restrains the movement of the flapper door 150 to a predetermined rotational speed that is less than the predetermined rotational speed of the lever 82. In the illustrative embodiment, the predetermined rotational speed of the flapper door 150 is approximately 0.9 to 1.5 rpm.

As a result, the flapper door 150 moves from the open position shown in FIG. 5 to the closed position shown in FIG. 4 more slowly than the lever 82 moves from the depressed position to the outward position. An opportunity is thereby provided for ice lagging in the chute 64 between the bin 62 and the guideway 96 to clear the chute 64 before the flapper door 150 reaches the closed position. In that way, ice is prevented from becoming wedged between the flapper door 150 and the chute 64, which could result in the flapper door 150 being held open and permit ambient air to enter the chute 64 and travel into the refrigerated compartment 30 of the refrigerator 10.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An ice dispenser comprising:

a mounting bracket;

a lever pivotally coupled to the mounting bracket;

a flapper door pivotally coupled to the mounting bracket, the flapper door being configured to pivot between a closed position and an open position;

a rotary damper coupled to the flapper door; and a linkage pivotably coupled to both the lever and the flapper door such that movement of the lever from a first lever position to a second lever position advances the flapper door from the closed position to the open position, wherein the linkage is configured to:

permit the lever to move from the second lever position to the first lever position independently of the flapper door at a first rotational speed; and permit the flapper door to move from the open position to the closed position at a second rotational speed that is different than the first rotational speed.

2. The ice dispenser of claim 1, wherein the second rotational speed is slower than the first rotational speed.

3. The ice dispenser of claim 1, wherein:

the lever comprises a housing having a passageway defined therein; and the flapper door comprises:

a plate positioned at an upper end of the passageway of the housing; and a bracket coupled to the plate, the bracket having a lower end moveably coupled to the rotary damper.

4. The ice dispenser of claim 3, wherein:

the bracket includes a sidewall having a slot defined therein; and the linkage comprises:

a roller positioned in the slot, the roller being configured to move along the slot; and a link arm having a first end pivotally coupled to the lever and a second end pivotally coupled to the roller.

5. The ice dispenser of claim 4, wherein:

the roller is positioned at an upper end of the slot as the lever is moved from the first lever position to the second lever position; and the roller is moved away from the upper end of the slot as the lever is moved from the second lever position to the first lever position.

6. The ice dispenser of claim 3, further comprising:

a chute configured to guide ice to the passageway of the housing, the chute having a mouth positioned adjacent to an upper end of the passageway, wherein:

when the flapper door is in the closed position, the flapper door is positioned over the mouth of the chute; and when the flapper door is in the open position, the flapper door is spaced apart from the mouth of the chute.

7. The ice dispenser of claim 3, wherein the lever further comprises:

a paddle extending downward from the housing, the paddle having a curved surface configured to receive a container for ice.

8. The ice dispenser of claim 1, further comprising:

a first torsional spring coupled to the lever and configured to bias the lever in the first lever position; and a second torsional spring coupled to the flapper door and configured to bias the flapper door in the closed position.

9. The ice dispenser of claim 8, wherein:

the first torsional spring is configured to urge the lever to move from the second lever position to the first lever position at the first rotational speed; and the rotary damper is configured to permit the flapper door to move from the open position to the closed position at the second rotational speed.

10. The ice dispenser of claim 1, wherein the first rotational speed is a pre-determined speed of greater than 1.5 rpm.

11. The ice dispenser of claim 1, wherein the second rotational speed is a pre-determined speed of approximately 0.9 rpm to 1.5 rpm.

12. The ice dispenser of claim 1, further comprising:

a switch, wherein the lever is configured to operate the switch when the lever is in the second lever position.

13. An ice dispenser comprising:

a lever configured to pivot about a first axis;

a flapper door configured to pivot about a second axis that is parallel to the first axis, the flapper door including a bracket having a slot defined therein;

a rotary damper engaged with the bracket of the flapper door;

a roller positioned in the slot of the bracket of the flapper door, the roller being configured to move along the slot; and a link having a first end pivotally coupled to the lever and a second end pivotally coupled to the roller, wherein:

the link is configured to advance the roller and the bracket upward such that movement of the lever about the first axis in a first direction causes the flapper door to move about the second axis in a second direction opposite the first direction;

the link is configured to allow the lever to pivot about the first axis in the second direction at a pre-determined first rotational speed;

when the lever pivots about the first axis in the second direction, the roller is moved downward along the slot such that the flapper door is permitted to pivot about the second axis in the first direction at a pre-determined second rotational speed; and the pre-determined first rotational speed is different than the pre-determined second rotational speed.

14. The ice dispenser of claim 13, wherein the pre-determined first rotational speed is faster than the pre-determined second rotational speed.

15. The ice dispenser of claim 13, wherein the rotary damper is configured to resist movement of the flapper door as the flapper door is pivoted about the second axis in the first direction.

16. The ice dispenser of claim 13, further comprising:

a biasing element configured to bias the flapper door in a closed position.

17. A refrigerator comprising an ice dispenser, the ice dispenser comprising:

a lever configured to move between a first lever position and a second lever position;

a flapper door configured to pivot, the flapper door including a bracket;

a roller positioned in a slot of the bracket of the flapper door, the roller being configured to move along the slot;

a link having a first end pivotally coupled to the lever and a second end pivotally coupled to the roller; and a rotary damper coupled to the flapper door;

wherein:

the link is configured to (i) move the flapper door from a closed position to an open position when the lever moves from the first lever position to the second lever position, and (ii) permit the lever to move from the second lever position to the first lever position at a first rotational speed; and the rotary damper is configured to resist movement of the flapper door such when the lever is moved from the second lever position to the first lever position, the flapper door is moved from the open position to the closed position at a second rotational speed that is slower than the first rotational speed.

18. The refrigerator of claim 17, further comprising:

an ice bin sized to contain ice;

a motor operable to advance ice from the ice bin; and a switch operable to control the motor, wherein:

the lever includes a control arm configured to operate the switch to energize the motor; and the control arm operates the switch when the lever is in the second lever position.

19. The refrigerator of claim 17, wherein the lever comprises:

a housing having a passageway defined therein.

20. The refrigerator of claim 19, further comprising:

a chute configured to guide ice to the passageway of the housing, the chute having a mouth positioned adjacent to an upper end of the passageway, wherein:

when the flapper door is in the closed position, the flapper door is positioned over the mouth of the chute; and when the flapper door is in the open position, the flapper door is spaced apart from the mouth of the chute.

* * * * *